United States Patent [19]

Erkens

[11] Patent Number: 4,609,915

[45] Date of Patent: Sep. 2, 1986

[54] APPARATUS FOR THE CONTROL OF ROTATING PARTS IN MACHINERY

[75] Inventor: Walter Erkens, Denzlingen, Fed. Rep. of Germany

[73] Assignee: Rhodia Aktiengesellschaft, Freiburg, Fed. Rep. of Germany

[21] Appl. No.: 546,406

[22] Filed: Oct. 28, 1983

[30] Foreign Application Priority Data

Jun. 11, 1983 [DE] Fed. Rep. of Germany ..... 3321261

[51] Int. Cl.[4] ..... G08B 21/00

[52] U.S. Cl. ..... 340/671; 242/36

[58] Field of Search ..... 340/671; 57/264; 250/231 SE, 351; 242/36; 324/175

[56] References Cited

U.S. PATENT DOCUMENTS

| | | | |
|---|---|---|---|
| 3,298,401 | 1/1967 | Stutz | 324/175 X |
| 3,633,835 | 1/1972 | Beers | 242/36 |
| 3,714,448 | 1/1973 | Cronan | 340/671 |
| 4,123,653 | 10/1978 | Bovio | 250/231 SE |
| 4,150,530 | 4/1979 | Derichs | 57/264 |
| 4,195,345 | 3/1980 | Artzt et al. | 57/264 |
| 4,204,115 | 5/1980 | Boldridge | 250/231 SE |

*Primary Examiner*—Jerry W. Myracle

*Attorney, Agent, or Firm*—Bucknam and Archer

[57] ABSTRACT

Device for monitoring rotating parts of machines and installations for the production, treatment and processing of monofilaments, yarns, wires, tapes, webs and the like on the accumulations and wraps being formed. According to the invention, the surface of the rotating part, e.g. of a friction roller of a high-speed winder for filament yarns, is provided with marks, and opposite this marked surface a sensor consisting of a transmitter and a receiver, for instance a sensor operating in the range of infrared radiation, is disposed, which by the passage of the marks generates a signal, the alteration of which causes, through switching elements, the stopping of the rotating part of the machine or of the installation. In contrast with the known devices, which operate mechanically, which are equipped with feelers and which indicate the formation of an accumulation only after a long time, the device according to the invention operates without mechanical contact, the formation of an accumulation being picked up at a very early stage.

2 Claims, 1 Drawing Figure

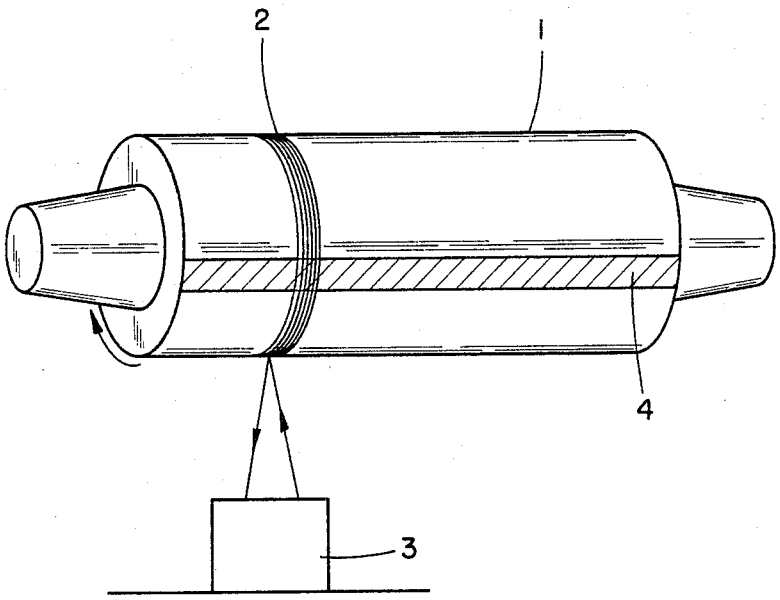
2
1
4
3

APPARATUS FOR THE CONTROL OF ROTATING PARTS IN MACHINERY

The invention relates to a device for controlling rotating parts of machines and installations used for the production, treatment and processing of monofilaments, yarns, wires, tapes, webs and the like on the formation of accumulations or wraps. The term "wires" is understood to mean, for example, metallic wires; the term "tapes" is understood to mean paper tapes or ribbons of textile fabrics, plastic or metal foils; and the term "webs" is understood to mean paper webs, web of textile fabrics or knits, nonwoven materials, plastic, metal foils or the like.

In the chemical fiber and textile industry, yarns are wound on cylindrical tubes in certain production stages. These tubes are normally driven by friction on the spooling machines and installations. As drive one uses so-called friction, drive, or delivery rollers, which are contacted by the tubes to be driven along a generatrix. The yarn to be wound on the tube runs, viewed in the yarn running direction, over the roller before the contact point roller/tube at a certain looping angle. In case of rupture of the yarn or if a filament yarn is involved, of individual filaments of the yarn, the yarn end or the filament ends lying on the roller before the contact point roller/tube will in most cases adhere to the roller. This causes a "yarn accumulation" or a "wrap" to form on the roller. This accumulation adversely affects the surface of the tube would up to that time, and there is the danger that certain parts of the machine or even the entire machine will be damaged by the accumulation if it assumes larger dimensions. This applies similarly also to other rotating parts of machines used in the chemical fiber and textile industry, for example, those rotating parts by means of which yarns are transported or deflected, that is, godet wheels, guide rollers, etc., and also to rotating parts of machines used for the production, treatment and processing of wires, such as metal wires, tapes, such as tapes of plastic foil or webs, such as textile fabric webs.

Devices are known which pick up the accumulation which has built up on the rotating parts of, for example, spooling machines and installations and which by sending a signal, report such a disturbance and/or bring about the arrest of the respective spooling point, of the machine, or of the installation. These devices operate mechanically. They use movably arranged feelers in the form of levers, rulers, or the like, which normally are parallel to the axis of the rotating part and have certain spacing from its surface. The amount of this spacing is determined, among other things, by the dimensions of the feeler, the type of attachment, and the possibility of aligning the feelers, the operating properties of the machine, and compliance with accident prevention regulations.

However, it has also been established that the accumulation formed on the surface of the rotating parts must have reached a certain thickness before it comes in contact with the feeler.

During the formation of the accumulation, therefore, first the mechanically operating feeler is contacted by the growing accumulation, and then, as the diameter of the accumulation increases, it travels a certain distance, at the end of which a switch connected with the feeler responds and generates a signal.

From the first contact between the accumulation revolving with the rotating parts, e.g. a roller, and the feeler until the signal switch responds, snarls form at the accumulation contact point feeler/accumulation, due to damage to the yarn. Due to the face that they are wound on the spool at the affected or at adjacent spooling points, these snarls influence the quality of the yarn or yarns, leading to difficulties in the further processing. In addition, the operational safety of the rotating and linearly moving parts of the spooling machine is impaired by the snarls. This is found to be very disadvantageous, especially at the high speed of winding, rewinding and processing machines in the chemical fiber production plants.

The disadvantages discussed hereinabove apply similarly also to rotating parts of machines and installations for the production, treatment and processing of wires, tapes or webs.

An object of the present invention is to provide a device for monitoring rotating parts on the growing accumulations or wraps of the type described hereinabove with which the disadvantages of the known devices for picking out the wraps or accumulations on rotating parts are avoided.

FIG. 1 illustrates the device according to the present invention.

Numeral 1 is the rotating part; numeral 2 designates the wraps or accumulations; numeral 3 designates the sensor; numeral 4 designates the marks.

The device according to the invention offers the advantage that a wrap or accumulation forming on a rotating part of a machine or installation for the production, treatment or processing of monofilaments, yarns, wires, tapes, webs or the like is picked up at an early stage, and above all, without mechanical contact. By stopping the rotating part of the machine or of the installation, which occurs due to the variation of the signal generated by the sensor, the formation of larger wraps or accumulations is prevented. In machines and installations for the production, treatment and processing of yarns, e.g. in the chemical fiber industry, the formation of snarls is also avoided.

According to the invention, the surface of the rotating parts is made in such a manner that marks form. These marks must, of course, be of such a nature as to fulfill also the technological requirements with regard to surface structure and roughness and wear, among others. The marking of the rotating parts may be effected e.g. by subdividing their surface into zones of different brightness or into zones of different reflectivity. This can be achieved, for example, by dyeing or staining surface parts, by applying or inlaying surface parts of materials different from the base material of which the surface of the rotating part consists, by a different execution of the suface structure and/or different surface roughness and/or achieving a different form.

As switching elements, relays, for example, may be used.

The invention will be explained more specificially with reference to the following example.

EXAMPLE

On a conventional high-speed winder for chemical fiber yarns operating at a velocity in the range of from 3,500 to 5,000 m/min., which can operate on the principle of frictional as well as shaft drive, the feeler ruler which was spaced 3 mm from the surface of the cylindrical friction roller and was arranged parallel to the axis and which actuates an electric switch when deflected by a wrap forming on the friction roller was removed. On the surface of the friction roller, which in the original state, had a dull chromium plating on the entire circumference, a bright chromium plating was applied by electroplating on a 20 mm wide strip extending parallel to the axis over the entire length of the friction roller. The diameter of the roller was 160 mm.

On six bobbin tubes to be wound simultaneously, an equal number of sensors, IR photocells, operating in the range of infrared radiation and each consisting of a transmitter and a receiver were arranged spaced 5 mm from the surface and perpendicular to the median axis of the friction roller, in such a way that each sensor was centered on the winding stroke of the respective bobbin tube.

For the design of the sensors, the following conditions applied:

When the mat chromium-plated area of the friction roller is under the sensor, the electric signal sent by the sensor has a voltage of 50 millivolt. When the bright chromiumplated strip on the friction roller is under the sensor, the signal has a voltage of 200 millivolt. At a speed of 8400 revolutions per minute, there resulted 8400 signal changes per minute, corresponding to a frequency of 140 Hz.

The electronic evaluating system belonging to the switching elements was adjusted for an operating range of from 100 to 200 Hz; it forwarded a collective signal to the output relays belonging to the switching elements whenever the frequency of the signal change coming from the sensors was below 40 Hz for at least 1.0 second.

Upon rupture of one of the six filament yarns to be spooled on the same winder, polyamide-6,6, of titer 101 dtex and 17 single filaments, the frequency dropped to below 40 Hz, leading to disconnection of the high-speed winder and simultaneous capping, cutting off of the yarns of the other five bobbins of the winder.

After the friction roller came to a stop, the thickness of the accumulation on the roller was measured. Only a few layers of yarn, of a total thickness of less than 0.5 mm., were found.

What is claimed is:

1. A device for monitoring rotating parts of machines and installations for the production, treatment and processing of monofilaments, yarns, wires, tapes, webs and the like on the formation of wraps or accumulations, wherein the surface of the rotating part is provided with marks, and opposite the marked surface, a sensor consisting of a transmitter and a receiver is arranged, said sensor being of the type operating in the range of visible light, infrared radiation or ultraviolet radiation, the marks having then, compared with the remaining surface of the rotating part, a different brightness, different infrared reflectivity or different ultraviolet reflectivity respectively, or of the type operating in the range of ultrasonics or of the type operating pneumatically, the marks having then, compared with the remaining surface of the rotating part, a different ultrasonics reflectively or differently form respectively, which due to the passage of the marks, generates a signal proportional to the frequency of the rotating part, and an electronic evaluating system belonging to switching elements, which is adjusted for a reference frequency, forwards a signal to output relays belonging to the switching elements when, due to the beginning of the formation of a wrap or accumulation, the signal coming from the sensor falls below the said reference frequency during a time span the electronic evaluating device is previously set for, the switching elements then bring about the arrest of the rotating part of the machine or of the installation, wherein the marks consist of strips disposed parallel to the axis of rotation of the rotating part, or of strips disposed inclined with respect to the axis of rotation of the rotating part.

2. Device according to claim 1, characterized by the fact that the sensor is one operating in the range of infrared radiation (IR), and the marks have an IR reflectivity different from the remaining surface of the rotating part.

* * * * *